US010467996B2

(12) United States Patent
Yoshino et al.

(10) Patent No.: US 10,467,996 B2
(45) Date of Patent: Nov. 5, 2019

(54) CYMBAL DAMPING TOOL AND METHOD OF PRODUCING THE SAME

(71) Applicant: Roland Corporation, Shizuoka (JP)

(72) Inventors: Kiyoshi Yoshino, Shizuoka (JP); Yuichi Sawada, Shizuoka (JP)

(73) Assignee: Roland Corporation, Shizouka (JP)

( * ) Notice: Subject to any disclaimer, the term of this patent is extended or adjusted under 35 U.S.C. 154(b) by 0 days.

(21) Appl. No.: 16/231,398

(22) Filed: Dec. 22, 2018

(65) Prior Publication Data

US 2019/0197998 A1 Jun. 27, 2019

(30) Foreign Application Priority Data

Dec. 26, 2017 (JP) ..... 2017-248907

(51) Int. Cl.
*G10D 13/06* (2006.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 4,037,509 A * 7/1977 Slomovits ..... G10D 13/06 84/422.3
5,922,980 A * 7/1999 Arteaga ..... G10K 11/002 84/411 M
5,965,834 A * 10/1999 Suenaga ..... G10D 13/06 84/422.3
6,720,491 B1 4/2004 Kroncke
7,763,788 B2 * 7/2010 Wachter ..... G10D 13/06 84/411 M
8,334,448 B2 * 12/2012 Onheiser ..... G10D 13/06 84/421
8,981,195 B2 * 3/2015 Johnston ..... G01D 13/06 84/453
9,040,795 B2 * 5/2015 Yoshino ..... G10D 13/06 84/402
9,082,378 B2 * 7/2015 Miyashita ..... G10D 13/065
9,099,072 B2 * 8/2015 Yoshino ..... G10K 11/002
9,336,759 B2 * 5/2016 Mori ..... G10H 1/32
9,858,905 B2 1/2018 Tanabe
10,043,499 B2 8/2018 Yoshino et al.
2004/0011186 A1 1/2004 Hester, III
(Continued)

FOREIGN PATENT DOCUMENTS

JP 2014066832 4/2014
JP 2015064553 4/2015
JP 2016133720 7/2016

OTHER PUBLICATIONS

"Search report of Europe Counterpart Application," dated May 17, 2019, pp. 1-15.

*Primary Examiner* — Robert W Horn
(74) *Attorney, Agent, or Firm* — JCIPRNET

(57) ABSTRACT

There is provided a cymbal damping tool that is attached to a cymbal. The damping tool includes a cylindrical part, a membrane part configured to be a film shape or reticulated and having an inner edge connected to the cylindrical part and disposed on a lower surface side of the cymbal, a frame part that is connected to an outer edge of the membrane part, and a first sensor that is attached to an upper surface of the membrane part.

20 Claims, 8 Drawing Sheets

(56) References Cited

U.S. PATENT DOCUMENTS

| | | | | |
|---|---|---|---|---|
| 2010/0024624 | A1 | 2/2010 | Wachter | |
| 2013/0025547 | A1 | 10/2013 | Prefontaine | |
| 2014/0083276 | A1 | 3/2014 | Yoshino | |
| 2019/0197998 | A1* | 6/2019 | Yoshino | G10D 13/06 |

* cited by examiner

CYMBAL DAMPING TOOL AND METHOD OF PRODUCING THE SAME

CROSS-REFERENCE TO RELATED APPLICATION

This application claims the priority of Japan patent application serial no. 2017-248907, filed on Dec. 26, 2017. The entirety of the above-mentioned patent application is hereby incorporated by reference herein and made a part of this specification.

BACKGROUND

Technical Field

The disclosure relates to a cymbal damping tool and a method of producing the same, and particularly, to a cymbal damping tool that can prevent the original sound quality of a cymbal from deteriorating and reduce a sound generated by striking a cymbal, and a method of producing the same.

Description of Related Art

There are known techniques for reducing the sound of striking a cymbal by bringing a cymbal damping tool into contact with the cymbal. For example, in Patent Document 1, a cymbal damping tool which includes an annular frame and an elastic member that is disposed on an upper surface of the frame and in which the frame is brought into close contact with a lower surface of a cymbal with the elastic member therebetween is described. According to the cymbal damping tool, since the elastic member can always be brought into close contact with the lower surface of the cymbal, it is possible to quickly attenuate vibration from striking the cymbal.

PATENT DOCUMENTS

[Patent Document 1] Japanese Patent Publication No. 2014-066832 (for example, paragraphs 0052 and 0053, FIGS. 1 and 4)

However, the related art described above has problems in that, since the elastic member is always in close contact with the lower surface of the cymbal, a lingering sound of vibration (sound) of the cymbal after striking is shortened and the sound quality greatly changes compared to that of the original cymbal.

SUMMARY

An objective of the disclosure is to provide a cymbal damping tool that can prevent the original sound quality of a cymbal from deteriorating and reduce a sound generated by striking a cymbal.

In order to achieve the above objective, a cymbal damping tool of the disclosure includes a cylindrical part; a membrane part configured to be a film shape or reticulated and having an inner edge connected to the cylindrical part and disposed on a lower surface side of the cymbal; a frame part that is connected to an outer edge of the membrane part; and a first sensor that is attached to an upper surface of the membrane part.

BRIEF DESCRIPTION OF THE DRAWINGS

FIG. 7(*b*) is a cross-sectional view of a cymbal damping tool and a cymbal, wherein the cymbal damping tool shows a second modified example of the covering member.

DESCRIPTION OF THE EMBODIMENTS

Figure 1A:
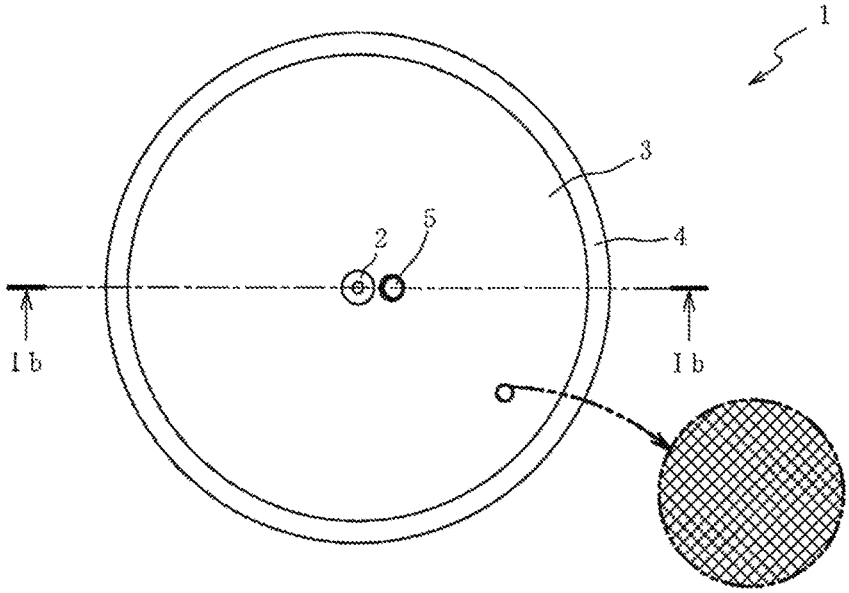
FIG. 1(*a*) is a top view of a cymbal damping tool according to a first embodiment and FIG. 1(*b*) is a partially enlarged cross-sectional view of the cymbal damping tool taken along the line Ib-Ib in FIG. 1(*a*).
Figure 1B:
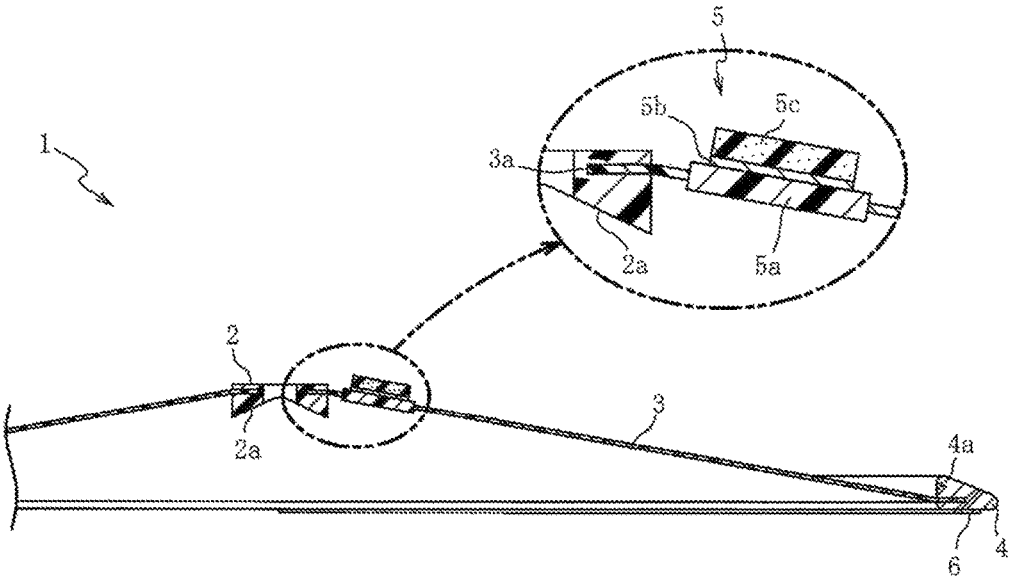

Preferable embodiments will be described below with reference to the appended drawings. First, a detailed configuration of a cymbal damping tool 1 will be described below with reference to FIG. 1. FIG. 1(*a*) is a top view of the cymbal damping tool 1 according to a first embodiment and FIG. 1(*b*) is a partially enlarged cross-sectional view of the cymbal damping tool 1 taken along the line Ib-Ib in FIG. 1(*a*).

As shown in FIG. 1, the cymbal damping tool 1 includes a cylindrical part 2 having a cylindrical shape, a film-shaped membrane part 3 which is formed in a disc shape having a through-hole 3*a* at its center in a radial direction and has an inner edge that is connected to the cylindrical part 2, an annular frame part 4 that is connected to the outer edge of the membrane part 3, a first sensor 5 that is attached to an upper surface of the membrane part 3, and a second sensor 6 that is attached to a lower surface of the frame part 4.

The cylindrical part 2 includes a recessed part 2*a* that is recessed in a V-shaped cross section from a lower surface to one side in an axial direction (the upper side in FIG. 1(*b*)), and is made of a resin material (in the present embodiment, glass-reinforced nylon). The recessed part 2*a* is formed by cutting a V-shaped cross section out of a lower surface of the cylindrical part 2 having a cylindrical shape in a direction orthogonal to an axis of the cylindrical part 2.

The membrane part 3 is formed in a truncated cone shape using a reticulated material having predetermined flexibility (in the present embodiment, a polyester mesh having a thread diameter of 0.2 mm and a number of meshes (a number of threads per inch) set to 75). A part of the inner edge side of the membrane part 3 is integrally formed with the cylindrical part 2 by die molding, and an opening of the through-hole 3*a* is enclosed by the cylindrical part 2.

The frame part 4 includes a protrusion 4*a* that protrudes to one side of the membrane part 3 in the axial direction (the upper side in FIG. 1(*b*)) from the outer edge of the membrane part 3 and is made of a resin material (in the present embodiment, glass-reinforced nylon having a flexural modulus of 8,000 MPa according to ASTM D790 standards) having higher rigidity than the membrane part 3.

A part of the outer edge side of the membrane part 3 is integrally formed with the frame part 4 by die molding and the outer edge is connected to the frame part 4 while the membrane part 3 has slackness. Since the frame part 4 is made of a material having higher rigidity than the membrane part 3, and the frame part 4 is connected to the outer edge of the membrane part 3, even if the membrane part 3 is formed into a film shape using a material having predetermined flexibility, the disc shape of the membrane part 3 can be held by the frame part 4.

That is, for example, when only the frame part 4 is supported, the membrane part 3 has a degree of flexibility at which it deforms to be recessed downward under the weight of the cylindrical part 2 and the first sensor 5. However, in order to facilitate understanding, a state in which the center side of the membrane part 3 having a truncated cone shape is caused to protrude upward (a state in which only the cylindrical part 2 is supported) is shown in FIG. 1.

The first sensor 5 includes a disc-shaped plate 5*a*, a sensor 5*b* that is adhered to an upper surface of the plate 5*a*, and a cushion 5*c* that is adhered to an upper surface of the sensor 5*b*. The plate 5*a* is made of a resin material (in the present embodiment, glass-reinforced nylon) and is integrally formed with the membrane part 3 by die molding.

The sensor 5*b* is a piezoelectric sensor configured to detect vibration, and is adhered to an upper surface of the plate 5*a* using a double-sided tape (not shown). The cushion 5*c* is a buffer material that is formed in a cylindrical shape using an elastic material such as a sponge, rubber, or a thermoplastic elastomer, and is adhered to the upper surface of the sensor 5*b* using a double-sided tape.

The second sensor 6 is a sheet-shaped membrane switch configured to detect contact by detecting a change in the pressure. While the second sensor 6 extends over half of the circumference of the frame part 4 in the present embodiment, the second sensor 6 may extend over the entire circumference of the frame part 4 (may be formed in an annular shape).

When the cymbal damping tool 1 is produced, an upper mold and a lower mold having a cavity in a shape corresponding to the cylindrical part 2, the frame part 4, and the plate 5*a* are used. While the membrane part 3 is positioned on the cavity, the membrane part 3 is interposed between the upper mold and the lower mold, and when a resin material is injected into the cavity, the cylindrical part 2, the membrane part 3, the frame part 4, and the plate 5*a* are integrally formed.

Figure 2:
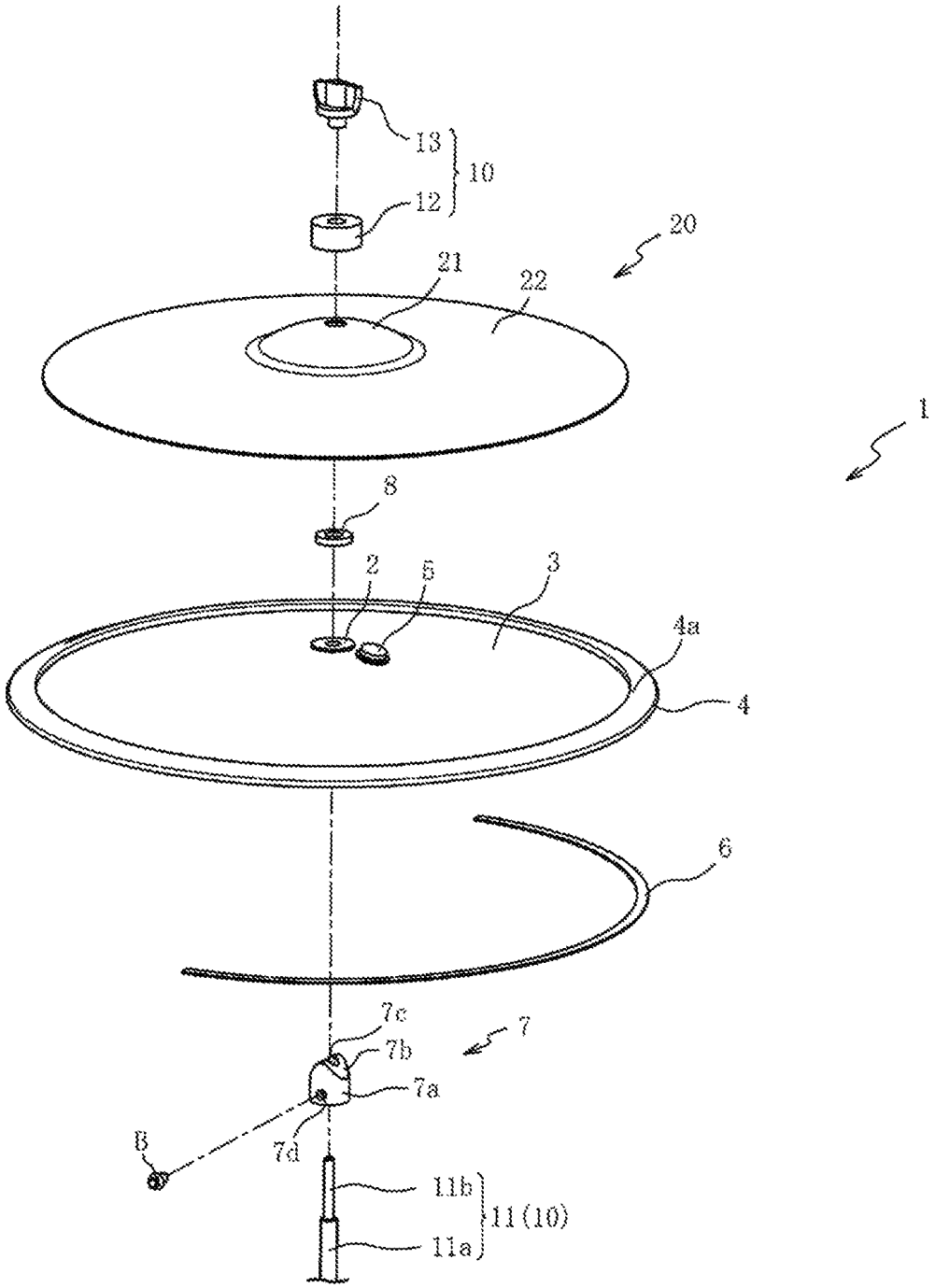
FIG. 2 is an exploded perspective view of the cymbal damping tool and a cymbal.

Next, a schematic configuration of the cymbal damping tool 1 and a cymbal 20 will be described with reference to FIG. 2. FIG. 2 is an exploded perspective view of the cymbal damping tool 1 and the cymbal 20. As shown in FIG. 2, the cymbal damping tool 1 and the cymbal 20 are supported by a cymbal stand 10. The cymbal stand 10 is a stand for placing the cymbal 20 at a position at which a player can easily play it. And the cymbal stand 10 includes a bar-shaped rod 11, a cymbal washer 12 and a fastening nut 13. The cymbal washer 12 and the fastening nut 13 are for fixing respective members (the cymbal 20 and the cymbal damping tool 1) into which the rod 11 is inserted.

The rod 11 is a metal part on which the cymbal 20 is supported, and includes a base part 11*a* that is formed in a cylindrical shape and a male screw part 11*b* that extends upward from the base part 11*a* and is formed in a cylindrical shape having a smaller diameter than the base part 11*a*, and a male screw is provided on the outer periphery of the male screw part 11*b*.

The cymbal washer 12 is a cylindrical member that is made of felt, and the inner diameter of the cymbal washer 12 is set to be larger than the outer diameter of the male screw part 11*b*. The fastening nut 13 is a nut that is attached to the male screw provided in the male screw part 11*b* and limits displacement of the cymbal washer 12 with respect to the rod 11.

The cymbal 20 is a metallic acoustic crash cymbal of which an upper surface is struck by a player. The cymbal 20 includes a bell part 21 constituting a central part thereof and a bow part 22 that extends in a flange shape from the outer edge of the bell part 21.

The bell part 21 is a bowl-shaped part that inclines downward from the center toward outside in the radial direction and an insertion hole into which the rod 11 is inserted is provided at the center of the bell part 21. The bow part 22 is an annular part that inclines downward from the bell part 21 toward outside in the radial direction. The inclination of the bow part 22 is formed more gently than the inclination of the bell part 21.

The cymbal damping tool 1 includes a limiting member 7 that limits rotation of the cylindrical part 2 with respect to the rod 11 and a spacer 8 that regulates a facing interval between the cymbal 20 and the cylindrical part 2 (the membrane part 3).

The limiting member 7 includes a cylindrical main body part 7*a*, a projection 7*b* that projects from the main body part 7*a* toward one side in the axial direction (the upper side in FIG. 2), a through-hole 7*c* (refer to FIG. 3) having a circular cross section which penetrates through the main body part 7*a* and the projection 7*b* in the axial direction of the main body part 7*a*, and a fixing hole 7*d* which communicates with the through-hole 7*c* and extends from the outer peripheral surface of the main body part 7*a* in a direction orthogonal to the axial direction of the main body part 7*a*.

The projection 7*b* is a part for limiting rotation of the cylindrical part 2 with respect to the limiting member 7, and the through-hole 7*c* is a part into which the rod 11 is inserted. The fixing hole 7*d* is a part for fixing the limiting member 7 to the rod 11 by fastening a bolt B, and a female screw is provided on its inner peripheral surface.

The spacer 8 is a cylindrical member that is made of felt, and is a spacer for regulating a height (relative position) of the cylindrical part 2 with respect to the cymbal 20.

Figure 3A:
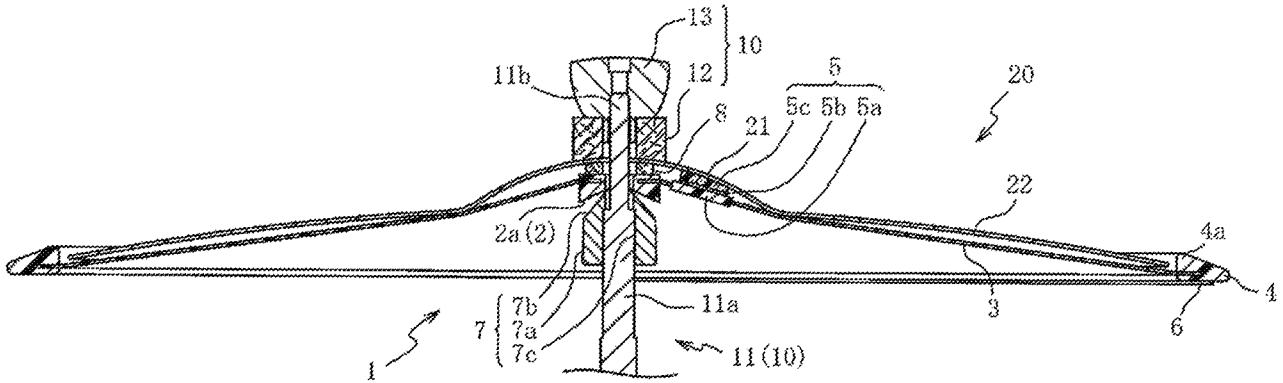
FIG. 3(*a*) is a cross-sectional view of the cymbal damping tool and the cymbal and FIG. 3(*b*) is a cross-sectional view of the cymbal damping tool and the cymbal during striking.
Figure 3B:
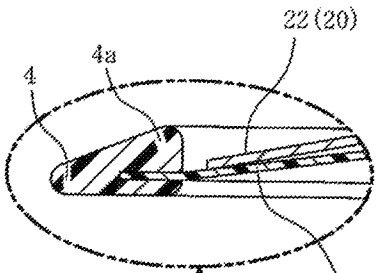
Figure 3B:
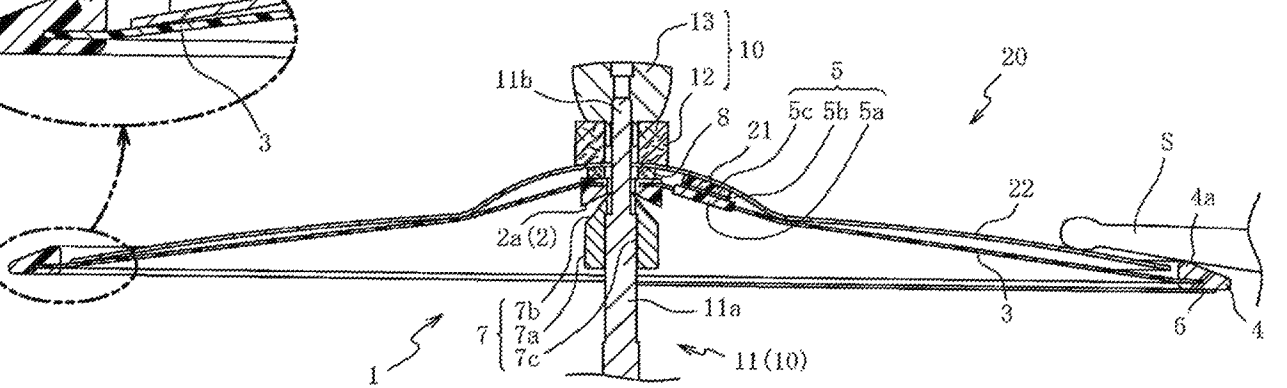

Next, with reference to FIG. 3(*a*), a method of installing the cymbal damping tool 1 on the cymbal 20 and the relationship between the cymbal 20 and the cymbal damping tool 1 after installation will be described. FIG. 3(*a*) is a cross-sectional view of the cymbal damping tool 1 and the cymbal 20.

As shown in FIG. 3(*a*), in order to install the cymbal damping tool 1 on the cymbal 20 (in order to support the cymbal 20 and the cymbal damping tool 1 on the rod 11), first, the rod 11 is inserted into the through-hole 7*c* of the limiting member 7. A step is formed on the inner peripheral surface of the through-hole 7*c*, and this step is fastened to the base part 11*a* of the rod 11. In this fastened state, when the bolt B is fastened to the fixing hole 7*d* (refer to FIG. 2) of the limiting member 7, the limiting member 7 is fixed to the rod 11 in a non-rotatable manner.

Next, when the recessed part 2*a* is engaged with the projection 7*b* of the limiting member 7 and thus the cylindrical part 2 is fitted into the male screw part 11*b*, the cylindrical part 2 is disposed above the limiting member 7. Then, the spacer 8, the cymbal 20, and the cymbal washer 12 are fitted to the male screw part 11*b* in that order and disposed above the cylindrical part 2. Finally, when the fastening nut 13 is fastened to the male screw part 11*b* and thus the cymbal 20 is fastened and fixed between the cymbal washer 12 and the cymbal damping tool 1, and the membrane part 3 is disposed on the lower surface side of the cymbal 20.

In this case, since the frame part 4 is formed in an annular shape of which the inner diameter is slightly larger than the outer diameter of the cymbal 20, the frame part 4 is disposed along the outer edge of the cymbal 20 at a position separated from the outer edge of the cymbal 20 by a predetermined interval (for example, 5 mm). Since the membrane part 3 having a truncated cone shape with slackness is fixed to the frame part 4, when an interval between the bell part 21 and the cylindrical part 2 is appropriately regulated by the spacer 8, the membrane part 3 can be disposed along the inclination of the bell part 21 and the bow part 22 (while it does not completely follow the inclination of the cymbal 20, its inclination is approximately the same as the inclination of the cymbal 20).

In the present embodiment, in a cross-sectional view of a plane including an axis of the cymbal 20, the thickness of the spacer 8 is set so that a lower end of the bell part 21 (a part at which the bell part 21 and the bow part 22 are connected) is positioned below a straight line connecting the inner edge and the outer edge of the membrane part 3. Therefore, a part of the upper surface of the membrane part 3 is brought into contact with the lower end of the bell part 21 (the part at which the bell part 21 and the bow part 22 are connected). While tension is applied to the membrane part 3 due to the contact and the weight of the frame part 4, since a variation in sizes occurs during die molding of the membrane part 3 and the frame part 4, the tension is not uniformly applied to the entire membrane part 3.

Therefore, since the membrane part 3 that is positioned outward in the radial direction from a lower end of the bell part 21 also has a part having slight slackness, there is a region in which the membrane part 3 and the bow part 22 are in contact with each other due to the slackness, in order to facilitate understanding, FIG. 3(*a*) shows a state in which the entire membrane part 3 on the outer peripheral side from the lower end of the bell part 21 (the part at which the bell part 21 and the bow part 22 are connected) is separated from the bow part 22. That is, during non-striking, a part of the membrane part 3 is not in contact with the cymbal 20 due to the slackness of the membrane part 3. Therefore, as will be described in detail below, when a facing interval between the cymbal 20 and the membrane part 3 is regulated, an area of the membrane part 3 in contact with the cymbal 20 can be regulated.

In addition, while the recessed part 2*a* of the cylindrical part 2 is engaged with the projection 7*b* of the limiting member 7, an angle formed by projecting surfaces of the projection 7*b* having a V-shaped cross section is set to be smaller than an angle formed by recessed surfaces of the recessed part 2*a* having a V-shaped cross section, and facing intervals between the recessed surfaces and the projecting surfaces gradually widen outward in the radial direction. In addition, the inner diameter of the cylindrical part 2 is set to a value larger than the diameter of the male screw part 11*b*, and the felt spacer 8 provided above the cylindrical part 2 has predetermined elasticity.

Therefore, while rotation of the cylindrical part 2 with respect to the limiting member 7 is limited by engagement between the recessed part 2*a* and the projection 7*b*, swing of the cylindrical part 2 using the projection 7*b* as a fulcrum between the limiting member 7 and the spacer 8 is allowed. That is, the cylindrical part 2, and the membrane part 3 and the frame part 4 connected to the cylindrical part 2 are relatively swingable with respect to the cymbal 20.

Next, operations of the cymbal 20 and the cymbal damping tool 1 when the cymbal 20 is struck will be described with reference to FIG. 3(*b*) and FIG. 4.

FIG. 3(*b*) is a cross-sectional view of the cymbal damping tool 1 and the cymbal 20 during striking. FIG. 4(*a*) and FIG. 4(*b*) are cross-sectional views of the cymbal damping tool 1 and the cymbal 20 after striking.

As shown in FIG. 3(*b*), when a player strikes the outer edge side of the cymbal 20 with a stick S, since the frame part 4 is positioned outward in the radial direction from the outer edge of the cymbal 20, the frame part 4 is easily struck. That is, when the frame part 4 made of a resin material is struck, it is possible to reduce a striking sound compared to when the metal cymbal 20 is struck. In addition, even when the frame part 4 and the cymbal 20 are struck at the same time, since it is possible to reduce a striking force on the cymbal 20 to the extent that the frame part 4 is struck, it is possible to reduce a striking sound when the cymbal 20 is struck.

Since the protrusion 4*a* is positioned above the outer edge of the cymbal 20 during non-striking, when the protrusion 4*a* is struck, the frame part 4 is displaced downward relative to the cymbal 20 so that the membrane part 3 in the vicinity of the striking position is separated from the lower surface of the cymbal 20. On the other hand, when the frame part 4 in the vicinity of the striking position is displaced downward, for the striking position, the frame part 4 in a region on the opposite side (hereinafter simply referred to as a "side opposite to the striking position) with an axis of the frame part 4 therebetween is displaced upward. In this case, since the membrane part 3 has predetermined flexibility, the membrane part 3 is deformed by the lower end of the bell part 21 as a fulcrum, and the membrane part 3 in the vicinity of a region on the side opposite to the striking position abuts the lower surface of the cymbal 20.

Figure 4A:
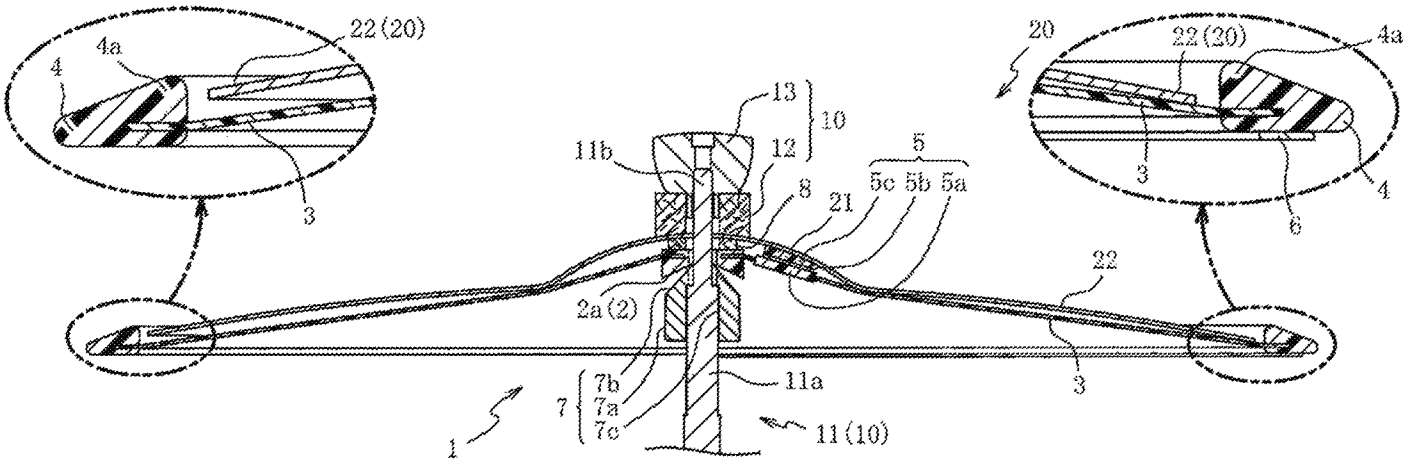
FIGS. 4(*a*) and 4(*b*) are cross-sectional views of the cymbal damping tool and the cymbal after striking.
Figure 4B:
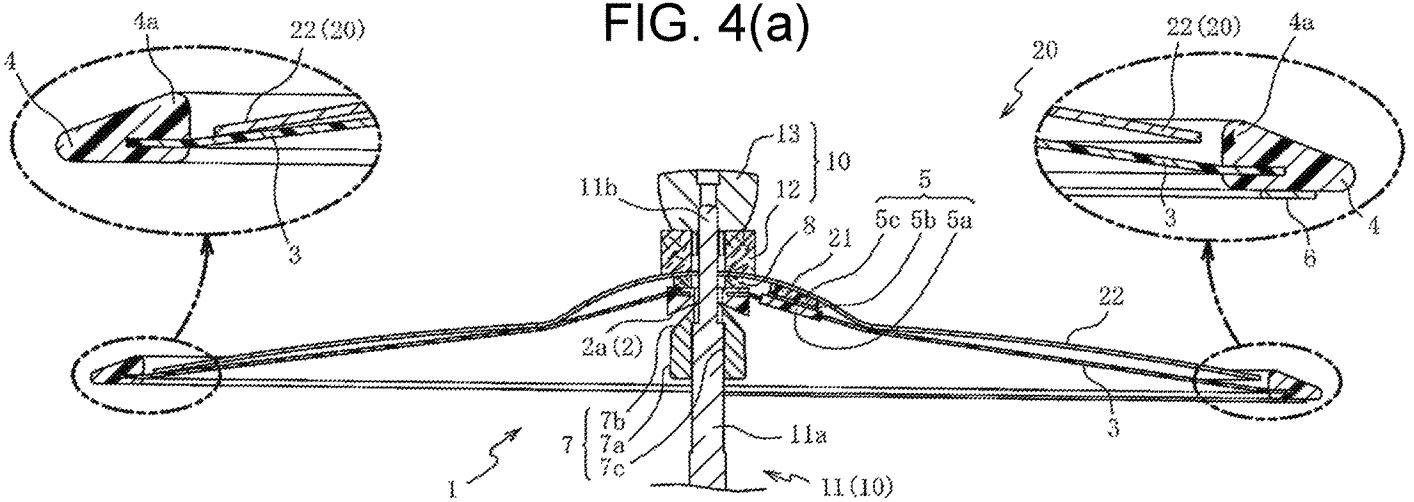

As shown in FIG. 4, when the stick S is separated from the cymbal 20 and the frame part 4 after striking, the frame part 4 in the vicinity of the striking position swings relative to the cymbal 20 so that it returns to an initial position (a relative position with respect to the cymbal 20 during non-striking), and the membrane part 3 in the vicinity of the striking position comes in contact with the lower surface of the cymbal 20 (refer to FIG. 4(*a*)). The membrane part 3 swings so that it is separated from the cymbal 20 in response to contact between the membrane part 3 in the vicinity of the striking position and the cymbal 20, and the membrane part 3 in the vicinity of the side opposite to the striking position comes in contact with the lower surface of the cymbal 20 (refer to FIG. 4(*b*)). Thereby, the membrane part 3 repeatedly comes in contact with and is separated from the lower surface of the cymbal 20 until swing of the cymbal 20 and the membrane part 3 (the frame part 4) is reduced.

In addition, even when only the cymbal 20 is struck without striking the frame part 4, due to a downward displacing orientation of the cymbal 20, the membrane part 3 is deformed by the lower end of the bell part 21 as a fulcrum, and the membrane part 3 in the vicinity of the striking position comes in contact with the lower surface of the cymbal 20. After striking, the cymbal 20 swings so that the membrane part 3 in the vicinity of the striking position and the cymbal 20 are separated from each other, and the membrane part 3 in the vicinity of the side opposite to the striking position comes in contact with the lower surface of the cymbal 20. That is, even when the frame part 4 is not struck, the membrane part 3 repeatedly comes in contact with and is separated from the lower surface of the cymbal 20 until swing of the cymbal 20 and the membrane part 3 (the frame part 4) is reduced.

In this manner, when the membrane part 3 having predetermined flexibility is held by the frame part 4 and is disposed on the lower surface side of the cymbal 20, the membrane part 3 is deformed by the lower end of the bell part 21 as a fulcrum due to swing of the cymbal 20 and the frame part 4, and the membrane part 3 is relatively swingable with respect to the cymbal 20. Thereby, it is possible to attenuate vibration of the cymbal 20 because the cymbal 20 and the membrane part 3 come in contact a plurality of times after striking, and quickly reduce volume resulting from striking the cymbal 20 to a predetermined value.

On the other hand, after volume resulting from striking the cymbal 20 is reduced to a certain level, relative swing of the membrane part 3 with respect to the cymbal 20 is also weakened. That is, when the state returns to a non-striking state in which a part of the membrane part 3 is not in contact with the cymbal 20 and thus attenuation of vibration of the cymbal 20 is reduced, it is possible to preserve a lingering sound of vibration (sound) of the cymbal 20. Thereby, it is possible to prevent the original sound quality of the cymbal 20 from deteriorating and it is possible to reduce a sound generated by striking the cymbal 20.

In addition, since the protrusion 4*a* of the frame part 4 is positioned above the outer edge of the cymbal 20 during non-striking, and thus the protrusion 4*a* is easily struck, the membrane part 3 easily swings relative to the cymbal 20 due to a striking force (the membrane part 3 easily repeatedly comes in contact with and is separated from the cymbal 20). Thereby, it is possible to attenuate large vibration of the cymbal 20 immediately after striking more effectively because it comes in contact with the membrane part 3 a plurality of times.

In addition, since the membrane part 3 is made of a material having predetermined flexibility, even if the membrane part 3 repeatedly comes in contact with and is separated from the cymbal 20, it is possible to prevent the occurrence of an abnormal sound (a striking sound generated when the membrane part 3 strikes the cymbal 20) during contact. Thereby, it is possible to prevent the original sound quality of the cymbal 20 from deteriorating more effectively.

Here, in order to reduce a sound generated when the cymbal 20 comes in contact with the membrane part 3 (to impart predetermined flexibility to the membrane part 3), for example, a configuration in which the membrane part 3 is made of a woven fabric, a nonwoven fabric, or a resin film can be used. However, in such a configuration, since a flow path of air from the upper surface side to the lower surface side of the membrane part 3 is easily interrupted, the sound of the cymbal 20 becomes a muffled sound, and the original sound quality deteriorates.

On the other hand, in the present embodiment, since the membrane part 3 is made of a reticulated material (refer to FIG. 1), it is possible to secure a flow path of air through meshes of the membrane part 3 (from the upper surface side to the lower surface side of the membrane part 3). Thereby, since vibration of the cymbal 20 can be transmitted to the outside through meshes of the membrane part 3, it is possible to prevent the sound of the cymbal 20 from becoming a muffled sound, and prevent the original sound quality of the cymbal 20 from deteriorating.

Since the first sensor 5 is installed between the membrane part 3 and the bell part 21, the first sensor 5 can detect vibration of the cymbal 20 during striking. Thereby, when the first sensor 5 is connected to a sound source device (not shown), the acoustic cymbal 20 can be used as an electronic cymbal. Since the cymbal damping tool 1 preserves a striking sound specific to the acoustic cymbal 20, it is possible to produce a striking sound specific to the acoustic cymbal 20 and an electronic sound according to an electronic cymbal from the sound source device at the same time.

Since the cushion 5*c* is disposed between the sensor 5*b* of the first sensor 5 and the bell part 21, even if the membrane part 3 swings relative to the cymbal 20, it is possible to prevent separation of the first sensor 5 from the bell part 21 by elastic deformation of the cushion 5*c*.

In addition, since the first sensor 5 is disposed inward in the radial direction from a contact part between the lower end of the bell part 21 and the membrane part 3, it is possible to prevent the cushion 5*c* of the first sensor 5 from being separated from the bell part 21. That is, when the membrane part 3 is brought into contact with the lower end of the bell part 21 and thus slight tension is applied to the membrane part 3, even if the membrane part 3 swings relative to the cymbal 20, it is possible to prevent the lower end of the bell part 21 from being separated from the membrane part 3. Thereby, when the first sensor 5 is disposed in the membrane part 3 that is positioned inward in the radial direction from the lower end of the bell part 21, it is possible to prevent separation of the cushion 5*c* of the first sensor 5 from the bell part 21 more effectively during swing of the cymbal 20 and the membrane part 3.

In this manner, when separation of the cushion 5*c* of the first sensor 5 from the bell part 21 is prevented, the sensor 5*b* can accurately detect vibration of the cymbal 20 due to striking. Thereby, it is possible to accurately generate a musical sound in response to striking the cymbal 20.

In addition, since the second sensor 6 is disposed along the lower surface of the frame part 4, the second sensor 6 can detect contact on the lower surface of the frame part 4. Thereby, for example, when a player grabs the outer edge of the cymbal 20 and the lower surface of the frame part 4, an electronic sound output from the sound source device is mute-controlled, and thus even if the cymbal 20 is used as an electronic cymbal, it is possible to perform choke playing.

Here, when the first sensor 5 and the second sensor 6 are provided on the cymbal damping tool 1, a wiring (not shown) for outputting a detection signal in the first sensor 5 and the second sensor 6 to the sound source device (not shown) is connected to the first sensor 5 and the second sensor 6. Thereby, the membrane part 3 and the frame part 4 to which the first sensor 5 and the second sensor 6 are attached rotate with respect to the rod 11, there is a risk of the wiring being entangled.

On the other hand, in the present embodiment, rotation of the cylindrical part 2 to which the membrane part 3 and the frame part 4 are connected with respect to the limiting member 7 is limited by engagement between irregularities of the recessed part 2*a* and the projection 7*b*. Thereby, since it is possible to prevent rotation of the membrane part 3 and the frame part 4 with respect to the rod 11 during striking the cymbal 20 and the frame part 4, it is possible to prevent the wiring connected to the first sensor 5 and the second sensor 6 from being entangled.

In this case, since the recessed part 2*a* and the projection 7*b* are formed as irregularities that extend in a V-shaped cross section, the cylindrical part 2 (the membrane part 3 and the frame part 4) is formed to relatively easily swing around an axis along an apex (ridgeline) of the projection 7*b*. In this case, in the present embodiment, the second sensor 6 is disposed over half of the circumference of the frame part 4 using a lower surface of the frame part 4 that is positioned (positioned at an end on the right side in FIG. 4) in a direction orthogonal to a direction along the vertex (ridgeline) of the projection 7*b* as a center. That is, when the cymbal 20 is played, since the side on which the second sensor 6 is disposed is easily directed to the player, an area in which the second sensor 6 is disposed is easily struck by the player.

Thereby, when the second sensor 6 is provided on the lower surface of the frame part 4 that is positioned in a direction orthogonal to a direction along the vertex (ridgeline) of the projection 7*b*, the cymbal 20 and the frame part 4 at this position are easily struck. Therefore, since the cylindrical part 2 (the membrane part 3) easily swings around an axis along the vertex (ridgeline) of the projection 7*b* by striking the cymbal 20 and the frame part 4, large vibration of the cymbal 20 immediately after striking is easily attenuated because it comes in contact with the membrane part 3 a plurality of times.

Here, while a part of the membrane part 3 comes in contact with the lower end of the bell part 21 in the present embodiment, the thickness of the spacer 8 may be changed (spacers with different thicknesses are used) and thus the membrane part 3 may be separated from the lower end of the bell part 21. That is, at least during striking the cymbal 20 and the frame part 4, the thickness of the spacer 8 may be regulated so that the membrane part 3 abuts the lower surface of the cymbal 20 by swing of the cymbal 20 and the frame part 4.

Even when the membrane part 3 is separated from the lower end of the bell part 21, since the cymbal 20 and the membrane part 3 relatively swing (they independently swing) when the cymbal 20 and the frame part 4 are struck, the membrane part 3 repeatedly comes in contact with and is separated from the lower surface of the cymbal 20. Thereby, it is possible to preserve a lingering sound of vibration (sound) of the cymbal 20 while volume resulting from striking the cymbal 20 is quickly lowered to a predetermined value.

Here, for example, in the case of a configuration in which a membrane part to which tension is applied is fixed to the frame part 4, if the thickness of the spacer 8 is changed, it is possible to slightly change a contact area with respect to the cymbal 20, and thus it is possible to regulate a degree of damping. However, if tension is applied to the membrane part, the membrane part is unlikely to be deformed along the shape of the cymbal 20. Therefore, even if the thickness of the spacer 8 is changed, a contact area with respect to the cymbal 20 hardly changes (regulation of a degree of damping is possible only in a small range).

On the other hand, in the present embodiment, since the membrane part 3 with slackness is fixed to the frame part 4 (the membrane part 3 is formed in a truncated cone shape using a material having flexibility), when a facing interval between the membrane part 3 and the cymbal 20 is appropriately set (the thickness of the spacer 8 is changed), it is possible to regulate an area (that is, a damping force of vibration of the cymbal 20 by the membrane part 3) of the membrane part 3 in contact with the cymbal 20. Thereby, it is possible to set a degree of damping according to an environment in which the cymbal 20 is used (a degree of damping can be regulated in a wide range).

Figure 5A:
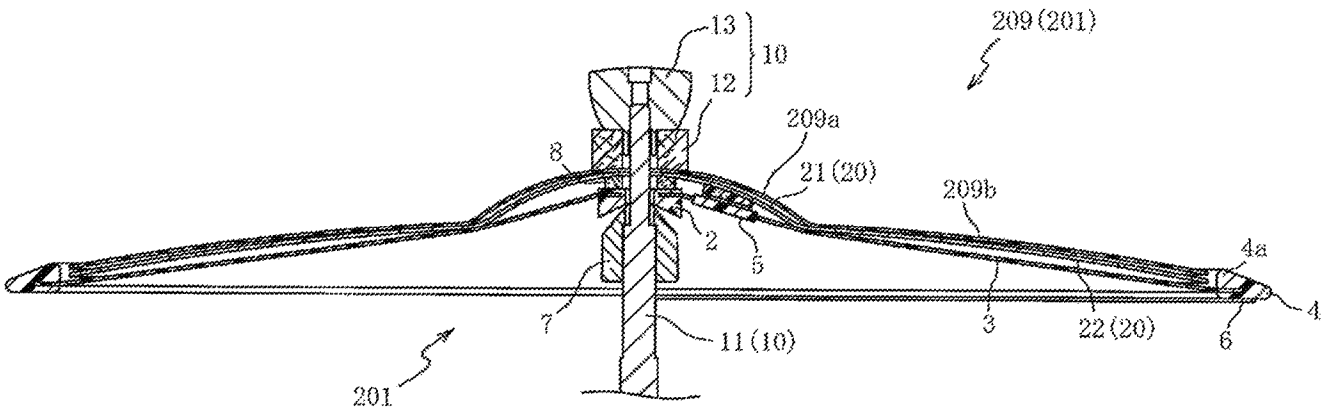
FIG. 5(*a*) is a cross-sectional view of a cymbal damping tool and a cymbal according to a second embodiment and FIG. 5(*b*) is a cross-sectional view of the cymbal damping tool and the cymbal during striking.
Figure 5B:
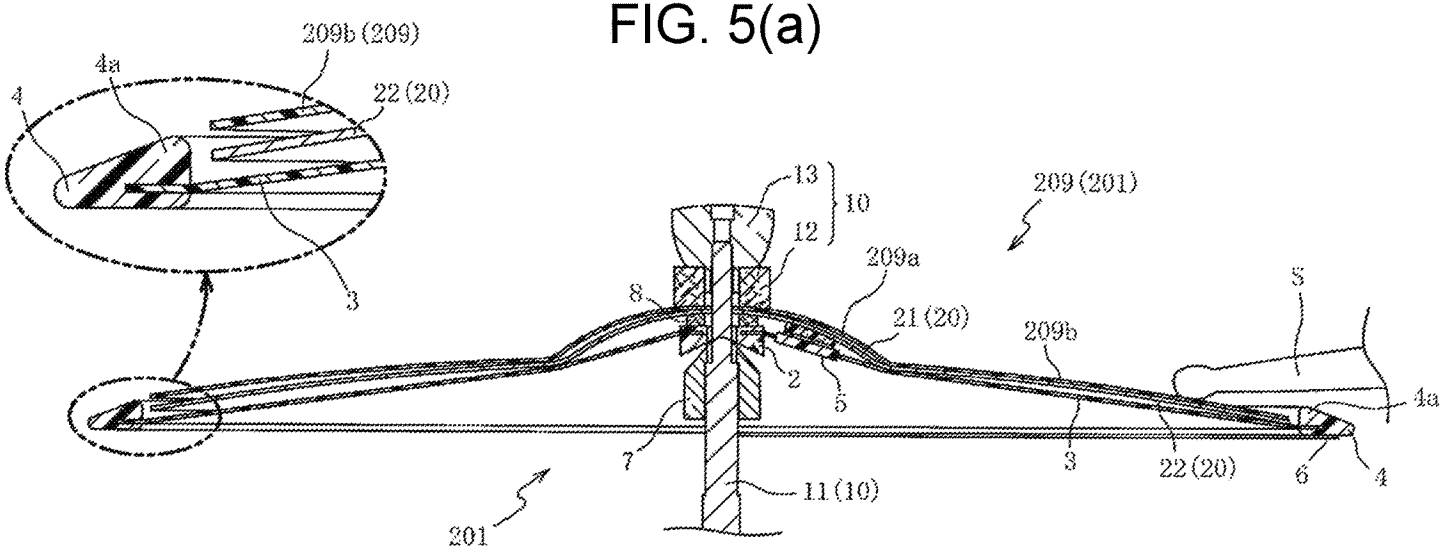

Next, a second embodiment will be described with reference to FIG. 5(*a*). While a case in which the membrane part 3 is disposed on the lower surface side of the cymbal 20 has been described in the first embodiment, a case in which a covering member 209 covers an upper surface of the cymbal 20 will be described in the second embodiment. Here, parts the same as those in the first embodiment described above will be denoted with the same reference numerals and descriptions thereof will be omitted. FIG. 5(*a*) is a cross-sectional view of a cymbal damping tool 201 and a cymbal 20 according to the second embodiment. Here, in FIG. 5(*a*), in order to simplify the drawings, some reference numerals are omitted (this similarly applies in FIG. 5(*b*) and FIG. 6).

As shown in FIG. 5(*a*), the cymbal damping tool 201 includes the covering member 209 that covers the upper surface of the cymbal 20. The covering member 209 includes a first covering part 209*a* that constitutes a central part thereof and a second covering part 209*b* that extends in a flange shape from the outer edge of the first covering part 209*a*.

The covering member 209 is made of a resin material and is formed of a reticulated material (in the present embodiment, a polyester mesh having a thread diameter of 1 mm, and a number of meshes (a number of threads per inch) set to 8) having a larger thread diameter than the membrane part 3, and has a rigidity (elasticity) that is set to higher than that of the membrane part 3 (the rigidity is set to be lower than that of the cymbal 20).

The first covering part 209*a* is a bowl-shaped part that inclines downward from the center toward outside in the radial direction, and a through-hole into which the rod 11 is inserted is provided at the center of the first covering part 209*a*. The second covering part 209*b* is an annular part that inclines downward from the first covering part 209*a* toward outside in the radial direction. The inclination of the second covering part 209*b* is formed more gently than the inclination of the first covering part 209*a*. That is, the first covering part 209*a* and the second covering part 209*b* are formed in substantially the same curved shape as the bell part 21 and the bow part 22 of the cymbal 20.

In the state that the covering member 209 is sandwiched in between the cymbal washer 12 and the cymbal 20, the rod 11 (male screw part) is inserted into the covering member 209. Since the outer diameter of the covering member 209 is set to be substantially the same as the outer diameter of the cymbal 20, substantially the entire area of the upper surface of the cymbal 20 in a top view is covered with the covering member 209.

In a state in which the covering member 209 is installed on the cymbal 20, a part of the covering member 209 is not in contact with the upper surface of the cymbal 20. More specifically, the first covering part 209*a* on the outer peripheral side of the cymbal washer 12 is not in contact with an upper surface of the bell part 21, and a part at which the first covering part 209*a* and the second covering part 209*b* are connected is brought into contact with the bow part 22 (a part connecting the bell part 21 and the bow part 22). In addition, a part of the inside of the second covering part 209*b* in the radial direction is in contact with the bow part 22 and a part that is positioned outward in the radial direction from the contact part is not in contact with the bow part 22.

That is, the covering member 209 has a self-sustaining degree of rigidity because the rigidity (elasticity) is set to be higher than that of the membrane part 3. For example, even if only the covering member 209 is supported by the rod 11, it has a rigidity sufficient to maintain the shape (substantially the same shape as the shape of the bell part 21 and the bow part 22) of the first covering part 209*a* and the second covering part 209*b*. Thereby, during non-striking, a state in which a part of the covering member 209 is not in contact with the cymbal 20 can be maintained by the rigidity of the covering member 209 itself.

Figure 6A:
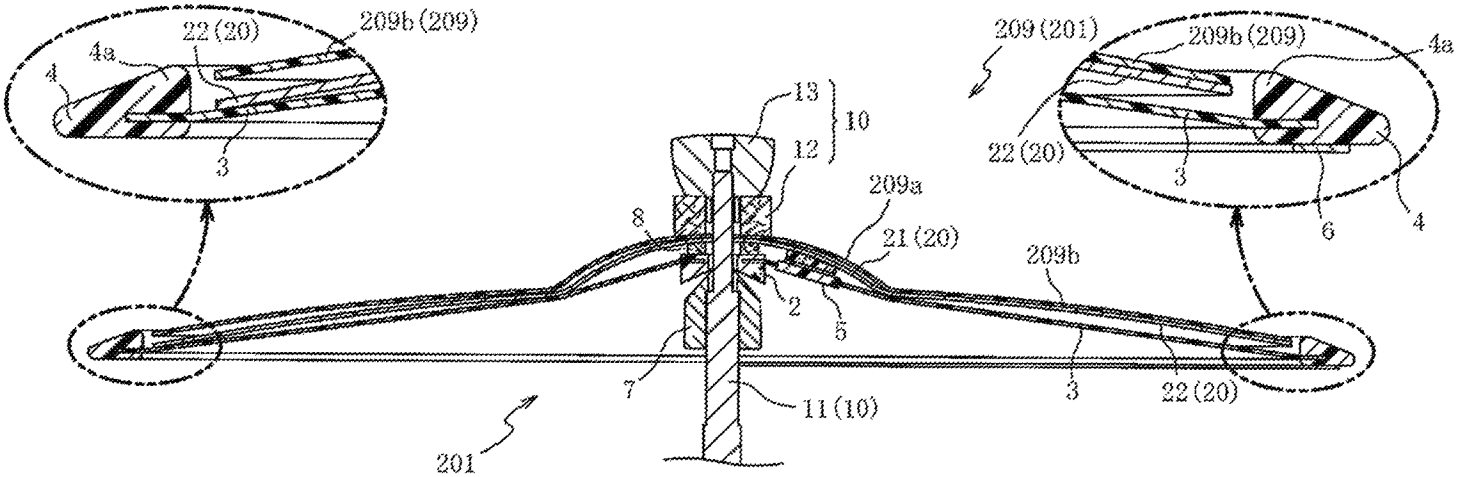
FIGS. 6(*a*) and 6(*b*) are cross-sectional views of the cymbal damping tool and the cymbal after striking.
Figure 6B:
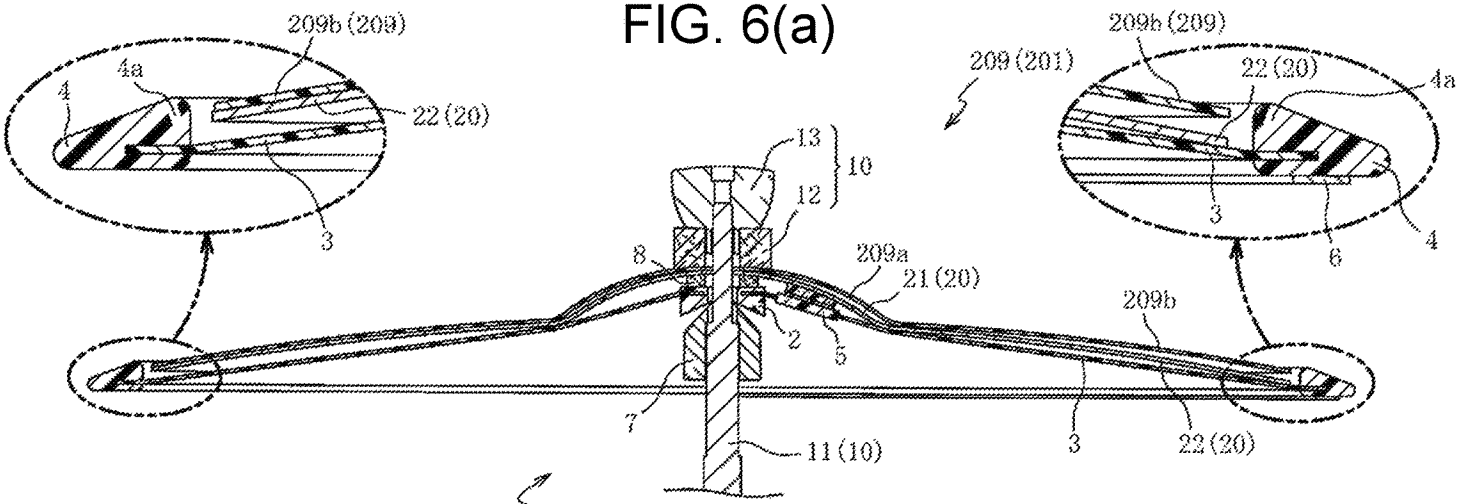

Next, operations of the cymbal 20 and the cymbal damping tool 201 when the cymbal 20 is struck will be described with reference to FIG. 5(*b*) and FIG. 6. FIG. 5(*b*) is a cross-sectional view of the cymbal damping tool 201 and the cymbal 20 during striking. FIG. 6(*a*) and FIG. 6(*b*) are cross-sectional views of the cymbal damping tool 201 and the cymbal 20 after striking.

As shown in FIG. 5(*b*) and FIG. 6, when the player strikes the cymbal 20 with the stick S, since the upper surface of the cymbal 20 is covered with the covering member 209, the covering member 209 is struck. Since the covering member 209 is made of a resin material, a striking sound can be reduced compared to when the metal cymbal 20 is directly struck.

When the covering member 209 is struck, the cymbal 20 and the covering member 209 swing downward (toward the membrane part 3) due to a striking force and the membrane part 3 is deformed using the lower end of the bell part 21 as a fulcrum due to swing of the cymbal 20. Therefore, the outer edge of the cymbal 20 comes in contact with (is interposed between) the covering member 209 (the second covering part 209*b*) and the membrane part 3 in the vicinity of the striking position. Thereby, it is possible to attenuate large vibration immediately after striking by the covering member 209 and the membrane part 3.

On the other hand, when the covering member 209 and the cymbal 20 in the vicinity of the striking position are displaced downward, in an area on the side opposite to the striking position, the covering member 209 and the membrane part 3 may be separated from the cymbal 20. However, when the stick S is separated from the covering member 209 (refer to FIG. 6), the covering member 209, the cymbal 20, and the membrane part 3 swing so that they return to the initial position, and the covering member 209 and the membrane part 3 repeatedly come in contact with and are separated from the cymbal 20 due to a difference in swing cycles of the covering member 209, the cymbal 20, and the membrane part 3.

In addition, even when the covering member 209 and the frame part 4 are struck at the same time, the covering member 209, the cymbal 20, and the membrane part 3 in the vicinity of the striking position swing so that they return to the initial position, and the covering member 209 and the membrane part 3 repeatedly come in contact with and are separated from the cymbal 20 due to a difference in swing cycles of the covering member 209, the cymbal 20, and the membrane part 3.

In this manner, a part of the covering member 209 is not in contact with the cymbal 20 during non-striking, and the covering member 209 is caused to have a self-sustaining degree of rigidity. Therefore, the covering member 209 swings relative to the cymbal 20 by striking the covering member 209, and the covering member 209 repeatedly comes in contact with and is separated from the upper surface of the cymbal 20. Thereby, since vibration of the cymbal 20 can be attenuated whenever the covering member 209 and the membrane part 3 come in contact with the cymbal 20, it is possible to quickly lower a volume resulting from striking the cymbal 20 to a predetermined value.

On the other hand, since a part of the covering member 209 is not in contact with the cymbal 20 during non-striking, after vibration of the cymbal 20 is attenuated to a certain level (relative swing of the covering member 209 with respect to the cymbal 20 is weakened), a part of the covering member 209 is not in contact with the cymbal 20, and it is possible to preserve a lingering sound of vibration (sound) of the cymbal 20. Thereby, it is possible to prevent the original sound quality of the cymbal 20 from deteriorating and it is possible to reduce a sound generated by striking the cymbal 20.

In addition, since the second covering part 209*b* of the covering member 209 is formed in a curved shape along an upper surface (curved surface) of the bow part 22, the second covering part 209*b* can be easily brought into surface-contact with the bow part 22 (increase a contact area). Thereby, even if the rigidity of the covering member 209 is made higher than that of the membrane part 3, it is possible to quickly attenuate vibration of the cymbal 20 by the covering member 209.

In addition, when the covering member 209 is made of a reticulated material, it is possible to secure a flow path of air through meshes (from one side to the other side of the covering member 209) of the covering member 209. Thereby, since vibration of the cymbal 20 can be transmitted to the outside through meshes of the covering member 209 (sound of the cymbal 20 can be prevented from becoming a muffled sound), it is possible to prevent the original sound quality of the cymbal 20 from deteriorating.

Figure 7A:
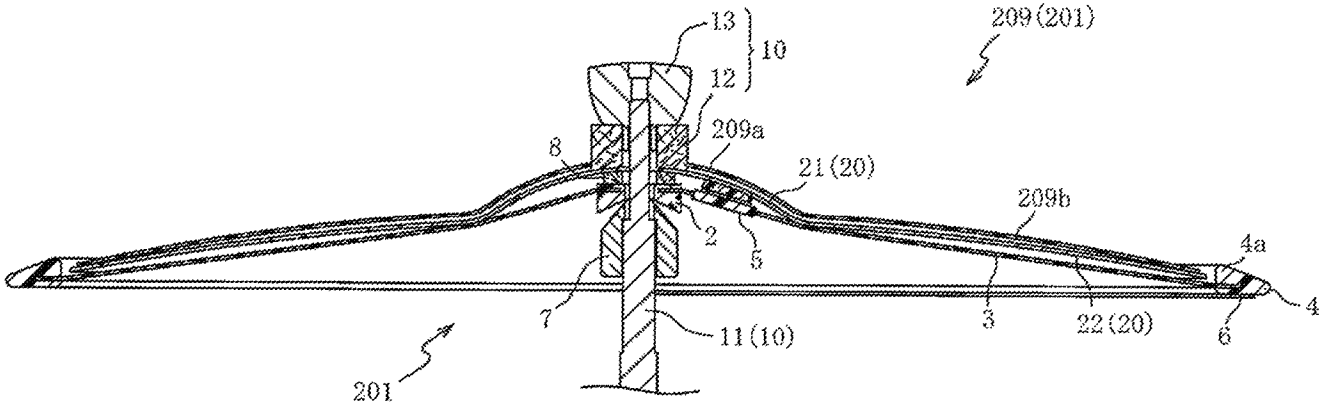
FIG. 7(*a*) is a cross-sectional view of a cymbal damping tool and a cymbal, wherein the cymbal damping tool shows a first modified example of the covering member.
Figure 7B:
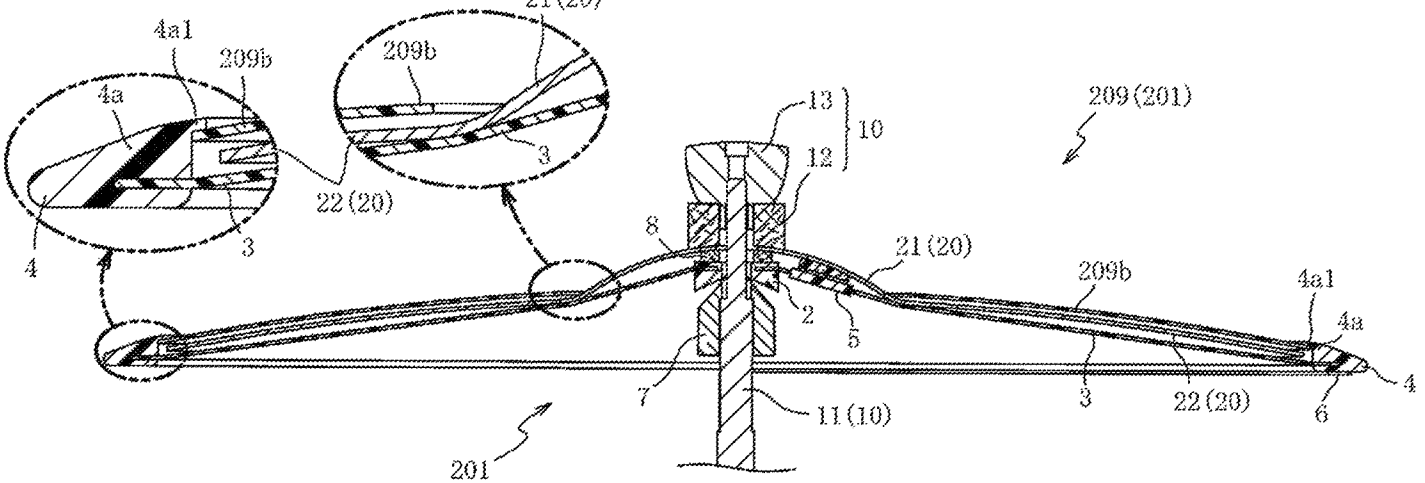

Next, a modified example of the covering member 209 will be described with reference to FIG. 7. FIG. 7(*a*) is a cross-sectional view of the cymbal damping tool 201 and the cymbal 20 which show a first modified example of the covering member 209. FIG. 7(*b*) is a cross-sectional view of the cymbal damping tool 201 and the cymbal 20 which show a second modified example of the covering member 209. Here, in FIG. 7, in order to simplify the drawings, some reference numerals are omitted.

As shown in FIG. 7(*a*), in the first modified example of the covering member 209, a through-hole of the first covering part 209*a* is formed slightly larger than the outer diameter of the cymbal washer 12 and the fastening nut 13, and the cymbal washer 12 is inserted into the through-hole of the first covering part 209*a*. Thereby, since it is not necessary to operate the fastening nut 13 when the covering member 209 is attached or detached, the covering member 209 can be easily attached or detached.

The outer edge of the second covering part 209*b* of the covering member 209 is in contact with the upper surface of the outer edge of the bow part 22, and the second covering part 209*b* and the first covering part 209*a* on the inner peripheral side from the contact part are not in contact with the bow part 22 and the bell part 21. That is, in the covering member 209, only a part of the outer edge side of the second covering part 209*b* comes in contact with the cymbal 20 and it has a self-sustaining degree of rigidity with the contact part as a support.

In this manner, when a part of the covering member 209 is not in contact with the cymbal 20 during non-striking, the covering member 209 swings relative to the cymbal 20 by striking the covering member 209 and the covering member 209 repeatedly comes in contact with and is separated from the upper surface of the cymbal 20. Thereby, it is possible to quickly lower a volume resulting from striking the cymbal 20 to a predetermined value. On the other hand, after vibration of the cymbal 20 is attenuated to a certain level, a part of the covering member 209 is not in contact with the cymbal 20, and it is possible to preserve a lingering sound of vibration (sound) of the cymbal 20.

As shown in FIG. 7(*b*), in the second modified example of the covering member 209, the first covering part 209*a* is omitted. In the protrusion 4*a* of the frame part 4, a protuberance 4*a*1 that protrudes inward in the radial direction from the upper end is formed, and the outer edge of the annular second covering part 209*b* is fastened to the protuberance 4*a*1. Before installing to the frame part 4, the second covering part 209*b* is formed in a flat plate shape, and its outer diameter is set to be slightly larger than the inner diameter of the frame part 4. Thereby, the second covering part 209*b* is fitted into the inner edge of the frame part 4 while it is bent to deflate the outer edge of the second covering part 209*b*, and thus the second covering part 209*b* is fastened to the protuberance 4*a*1 while a curved shape along the upper surface of the bow part 22 is maintained.

Thereby, during non-striking, the entire covering member 209 is separated from the upper surface of the cymbal 20. In this manner, even if the entire covering member 209 is not in contact with the cymbal 20 during non-striking, the cymbal 20 and the frame part 4 swing by striking the covering member 209, and the covering member 209 repeatedly comes in contact with and is separated from the upper surface of the cymbal 20. Thereby, it is possible to quickly lower a volume resulting from striking the cymbal 20 to a predetermined value. On the other hand, after vibration of the cymbal 20 is attenuated to a certain level, the entire covering member 209 is not in contact with the cymbal 20, and it is possible to preserve a longer lingering sound of vibration (sound) of the cymbal 20.

Figure 8:
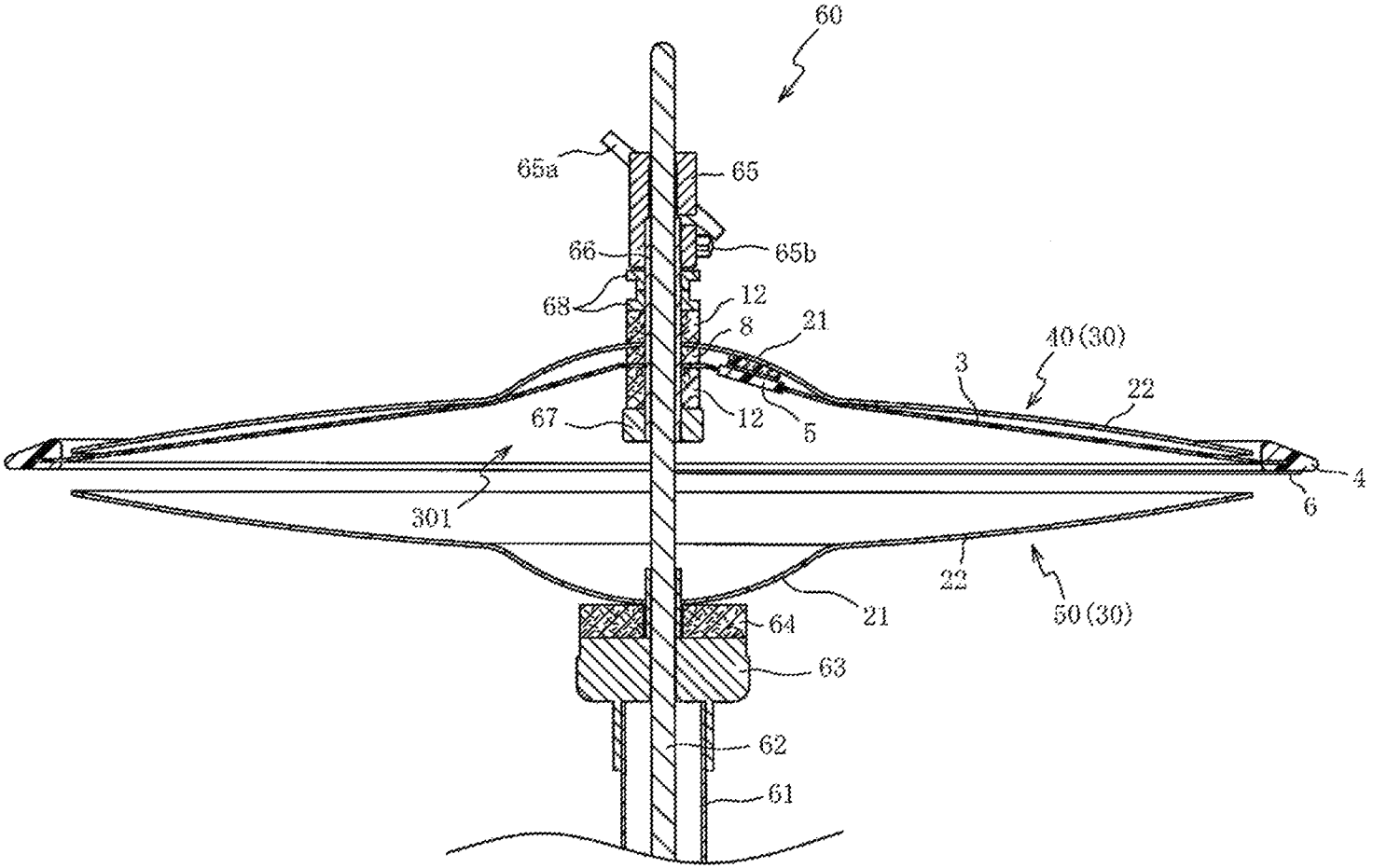
FIG. 8 is a cross-sectional view of a cymbal damping tool and a hi-hat cymbal according to a third embodiment.

Next, a third embodiment will be described with reference to FIG. 8. While a case in which the cymbal damping tool 1 is applied to the cymbal 20 constituted as a crash cymbal has been described in the first embodiment, a case in which a cymbal damping tool 301 is applied to a hi-hat cymbal 30 will be described in the third embodiment. Here, parts the same as those in the first embodiment will be denoted with the same reference numerals and descriptions thereof will be omitted. FIG. 8 is a cross-sectional view of the cymbal damping tool 301 and the hi-hat cymbal 30 according to the third embodiment. Here, in FIG. 8, in order to simplify the drawings, some reference numerals are omitted.

As shown in FIG. 8, the cymbal damping tool 301 has the same configuration as the cymbal damping tool 1 of the first embodiment except that the cylindrical part 2 and the limiting member 7 (refer to FIG. 1) are omitted.

The hi-hat cymbal 30 is a cymbal that is supported by a hi-hat stand 60 while two hi-hats including a top hi-hat 40 and a bottom hi-hat 50 which have the same outer diameter overlap so that rear surfaces thereof face each other. The top hi-hat 40 is positioned on the upper side in the axial direction and the bottom hi-hat 50 is positioned on the lower side.

When the cymbal damping tool 1 is applied to the hi-hat cymbal 30, the cymbal damping tool 1 is installed to the top hi-hat 40 that is struck by the player. Here, since the top hi-hat 40 and the bottom hi-hat 50 have the same configuration as the cymbal 20 in the first embodiment, details thereof will not be described.

The hi-hat stand 60 includes a hollow shaft 61 through which an installation height of the bottom hi-hat 50 can be adjusted, a rod 62 which is inserted into the hollow shaft 61 and moves up and down according to an operation of a pushing type pedal (not shown), a top support part that supports the top hi-hat 40, and a bottom support part 63 that supports the bottom hi-hat 50. The hi-hat stand 60 is self-supportable by a leg part (not shown) connected to a lower end of the hollow shaft 61.

The bottom support part 63 is a part that is provided at the upper end of the hollow shaft 61. When a bottom washer 64 and the bottom hi-hat 50 are inserted into a bottom shaft that protrudes from an upper surface of the bottom support part 63, the bottom hi-hat 50 is supported by the bottom washer 64. The bottom washer 64 is a cylindrical member made of felt and has predetermined elasticity, and thus the bottom hi-hat 50 is swingable and supported by the bottom support part 63.

The top support part includes a female screw part 65 into which the rod 62 is inserted (fixed to the rod 62) and in which a female screw is provided on the lower end side, a male screw part 66 into which the rod 62 is inserted and in which a male screw is provided on the outer peripheral surface, a lower nut 67 that is attached to a lower end side of the male screw part 66, and two upper nuts 68 that are attached to an upper end side of the male screw part 66.

A wing bolt 65*a* of the female screw part 65 is fastened and thus the top support part is fixed to the rod 62. On the other hand, when the wing bolt 65*a* is loosened, it is possible to adjust a position of the top support part in the axial direction of the rod 62. A rock bolt 65*b* of the female screw part 65 is fixed in a direction in which the player can easily adjust the wing bolt 65*a*.

While the lower nut 67 is attached to the male screw part 66, the cymbal washer 12, the membrane part 3, the spacer 8, the top hi-hat 40, and the cymbal washer 12 are sequentially inserted from the upper end of the male screw part 66, the two upper nuts 68 is attached to the male screw part 66, and the female screw part 65 is attached to the male screw part 66. Thereby, the top hi-hat 40 and the membrane part 3 are supported between the upper nut 68 and the lower nut 67 (the membrane part 3 is disposed on the lower surface side of the top hi-hat 40).

Next, when the female screw part 65 is fixed to the rod 62, the top hi-hat 40 and the membrane part 3 that can swing with respect to the rod 62 (the male screw part 66) are installed at the hi-hat stand 60. Here, when fastening of the two upper nuts 68 is adjusted, it is possible to adjust a distance between the upper nut 68 and the lower nut 67.

In a state (state in FIG. 8) in which pushing of a pedal (not shown) that vertically moves the rod 62 is released, the top hi-hat 40 and the membrane part 3 are separated from the bottom hi-hat 50, and this state is called an open state. In the open state, as in the first embodiment, in the membrane part 3 that is positioned outward in the radial direction from the bell part 21 of the top hi-hat 40, a part thereof is not in contact with the bow part 22 of the top hi-hat 40 (a part is in contact therewith). When the pedal is pushed in the open state, a state in which the membrane part 3 is interposed between the top hi-hat 40 and the bottom hi-hat 50 is brought, and this state is called a closed state.

When the player strikes the top hi-hat 40 and the frame part 4 in the open state, as in the first embodiment, the membrane part 3 swings relative to the top hi-hat 40 by striking the top hi-hat 40. Thereby, since the membrane part 3 comes in contact a plurality of times until vibration of the top hi-hat 40 weakens, it is possible to quickly lower a volume resulting from striking the top hi-hat 40 to a predetermined value and preserve a lingering sound of the sound.

When the state becomes a closed state while a lingering sound remains when the top hi-hat 40 is struck in the open state, since the bottom hi-hat 50 is in pressure-contact with the top hi-hat 40 with the membrane part 3 therebetween, it is possible to remove a lingering sound of vibration of the top hi-hat 40. In addition, since the membrane part 3 is made of a material having predetermined flexibility, when the open state is changed to the closed state, it is possible to reduce a contact sound due to contact between the top hi-hat 40 and the bottom hi-hat 50.

In the closed state, when the top hi-hat 40 and the frame part 4 are struck by the player, since the membrane part 3 having predetermined flexibility is interposed between the top hi-hat 40 and the bottom hi-hat 50, it is possible to quickly attenuate vibration of the top hi-hat 40 by the membrane part 3. In addition, in the closed state, since the membrane part 3 is pushed upward and toward the top hi-hat 40 by the bottom hi-hat 50 and an area of the membrane part 3 in contact with the top hi-hat 40 increases, it is possible to attenuate a striking sound in the closed state more effectively.

While the disclosure has been described above based on the embodiments, the disclosure is not limited to the embodiments, and it can be easily understood that various modifications and alternations can be made without departing from the spirit and scope of the disclosure. For example, while a case in which the cymbal damping tools 1 and 201 are installed on the cymbal 20 which is a crash cymbal has been described in the first and second embodiments, and a case in which the cymbal damping tool 301 is installed at the top hi-hat 40 of the hi-hat cymbal 30 has been described in the third embodiment, the disclosure is not necessarily limited thereto. Of course, it is possible to install the cymbal damping tool at a ride cymbal, a splash cymbal, or a China cymbal.

In addition, a part or all of any of the above embodiments may be combined with a part or all of the other embodiments to constitute a cymbal damping tool. Thereby, for example, a configuration of the covering member 209 of the second embodiment may be applied to the cymbal 20 and the top hi-hat 40 of the first and third embodiments.

In addition, as in the third embodiment, a configuration in which the cylindrical part 2 and the limiting member 7 are omitted can be applied to the first and second embodiments. In this case, a metal washer (fixed to the rod 11) may be provided in place of the limiting member 7, and the cymbal washer 12 may be separately provided between the metal washer and the membrane part 3.

While a case in which the membrane part 3 is made of a reticulated material using a resin material has been described in the above embodiments, the disclosure is not necessarily limited thereto. For example, the membrane part may be formed into a film shape using a woven fabric, a nonwoven fabric, or a resin film, or may be formed into a reticulated form using a natural fiber or a chemical fiber. In addition, the membrane part may be made of a reticulated material having elasticity. That is, when a material and an aperture ratio (a thread diameter and a number of meshes) of the membrane part are appropriately changed, a degree of damping can be regulated to a desired level. When a membrane part is formed of a non-reticulated material such as a woven fabric, a nonwoven fabric, or a resin film, a through-hole for forming the plate 5*a* may be formed in the membrane part. Thereby, even if the membrane part has a non-reticulated form, the membrane part and the plate 5*a* can be integrally formed by die molding.

While a case in which the membrane part 3 is made of a polyester mesh having a thread diameter of 0.2 mm and a number of meshes (a number of threads per inch) set to 75 has been described in the above embodiments, the disclosure is not necessarily limited thereto. For example, preferably, the membrane part is made of a polyester mesh having a thread diameter of 0.1 mm to 0.3 mm a number of meshes set to 20 to 100. Thereby, it is possible to impart predetermined flexibility to the membrane part.

Here, "predetermined flexibility" is a rigidity sufficient to elastically deform the membrane part due to contact of the membrane part in the cymbal 20 (the top hi-hat 40) when the membrane part swings relative to the cymbal 20 (the top hi-hat 40) during striking.

In addition, openings of the reticulated material (mesh) may not be uniformly formed over the entire membrane part 3. That is, an opening part that opens in a larger size than other openings in a part of the membrane part 3 and a cutout part obtained by cutting out a part of the inner edge and the outer edge of the membrane part may be provided. In addition, this opening part and cutout part may be formed in a slit shape. When such an opening part and cutout part are provided, it is possible to appropriately set an area of the membrane part in contact with the cymbal 20 (the top hi-hat 40), and it is possible to regulate a degree of damping of the cymbal 20 (the top hi-hat 40).

While a case in which the membrane part 3 is formed in a truncated cone shape has been described in the above embodiments, the disclosure is not necessarily limited thereto. For example, curved surface shapes may be combined to form a shape along the bell part 21 and the bow part 22. Thereby, it is possible to increase a damping force of vibration by the membrane part.

In addition, the outer edge of the membrane part may not be necessarily circular. The outer edge of the membrane part may be formed in a polygon shape (for example, a regular pentagon, a regular hexagon, or a regular dodecagon close to substantially a circular shape), an oval shape, or a shape obtained by combining straight lines and curves (for example, a semicircle). Thereby, for example, when a part of the outer edge of the membrane part is positioned on the inner peripheral side relative to the outer edge of the cymbal 20 (the top hi-hat 40), the frame part may be connected to the outer edge of the membrane part that is positioned on the outer peripheral side relative to the outer edge of the cymbal 20 (the top hi-hat 40). In this case, the cymbal damping tool may be installed on the cymbal 20 (the top hi-hat 40) so that a part in which the frame part is formed faces the player.

While a case in which the membrane part 3 that has slackness is fixed to the frame part 4 has been described in the above embodiments, the disclosure is not necessarily limited thereto. For example, a configuration in which the membrane part to which tension is applied may be fixed to the frame part 4 may be used. Even in such a configuration, when the membrane part is disposed at a position in contact with the lower surface of the cymbal 20 at least during striking, according to swing of the cymbal 20 and swing of the membrane part using the projection 7*b* as a fulcrum, the membrane part can be repeatedly brought into contact with the lower surface of the cymbal 20.

While a case in which the frame part 4 is formed in an annular shape (the frame part 4 is connected over the entire circumference of the outer edge of the membrane part 3) has been described in the above embodiments, the disclosure is not necessarily limited thereto. For example, the frame part may be formed in a polygon shape (for example, a regular pentagon, a regular hexagon, or a regular dodecagon close to substantially a circular shape), an oval shape, or a shape obtained by combining straight lines and curves (for example, a semicircle). That is, the frame part may be connected to at least the outer edge of the membrane part that is positioned on the outer peripheral side relative to the outer edge of the cymbal 20 (the top hi-hat 40) and the outer edge of the membrane part and the frame part may be partially disconnected.

While a case in which the frame part 4 is made of a resin material (glass-reinforced nylon) has been described in the above embodiments, the disclosure is not necessarily limited thereto. The material of the frame part 4 may have a strength at which it is not easily broken by striking and a rigidity sufficient to hold a disc shape of the membrane part 3. For example, a synthetic resin other than glass-reinforced nylon (for example, a polycarbonate or ABS resin), hard rubber, a metal, and wood may be used.

If the frame part 4 is made of a metal, when the frame part 4 is struck, a relatively large striking sound is generated. However, when the weight and the thickness of the frame part 4 and the type of the metal are adjusted, it is possible to reduce a striking sound when the frame part 4 is struck more than a striking sound when the cymbal 20 (the top hi-hat 40) is directly struck. In addition, when the frame part 4 is made of hard rubber, a metal, or wood, the frame part 4 may be fixed to the membrane part 3 using an adhesive or a rivet.

In addition, when the frame part 4 is made of a metal material, an elastic member made of an elastic material (for example, rubber) may be attached to an upper surface of the frame part 4. Thereby, even if the frame part 4 is metallic, it is possible to more reliably reduce a striking sound when the frame part 4 (elastic member) is struck than a striking sound when the cymbal 20 (the top hi-hat 40) is directly struck.

While a case in which the frame part 4 is formed of glass-reinforced nylon having a flexural modulus of 8,000 MPa according to ASTM D790 standards has been described in the above embodiments, the disclosure is not necessarily limited thereto. For example, preferably, the frame part 4 may be formed of a resin material having a flexural modulus of 200 MPa to 8,000 MPa according to ASTM D790 standards. Thereby, it is possible to impart a strength at which it is not easily broken by striking and a rigidity sufficient to hold a disc shape of the membrane part 3 to the frame part 4.

While a case in which the cylindrical part 2 and the plate 5*a* are formed of the same resin material (glass-reinforced nylon) as the frame part 4 has been described in the above embodiments, the disclosure is not necessarily limited thereto. For example, a configuration in which the material of the cylindrical part 2 and the plate 5*a* may be different from that of the frame part 4 may be used. For example, a synthetic resin other than glass-reinforced nylon (for example, a polycarbonate or ABS resin), hard rubber, a metal, and wood may be used. When the cylindrical part 2 and the plate 5*a* are formed of hard rubber, a metal, or wood, the cylindrical part 2 and the plate 5*a* may be fixed to the membrane part 3 using an adhesive or a rivet.

While a case in which the frame part 4 includes the protrusion 4*a* that protrudes to one side of the membrane part 3 in the axial direction from the outer edge of the membrane part 3 has been described in the above embodiments, the disclosure is not necessarily limited thereto. For example, a configuration in which the upper end of the frame part 4 is disposed at the same height as the outer edge of the cymbal 20 or at a lower position may be used. In this case, when a size of the frame part 4 in the radial direction is set to be larger, the frame part 4 is easily struck.

While a case in which the membrane part 3 and the frame part 4 are integrally formed by die molding has been described in the above embodiments, the disclosure is not necessarily limited thereto. For example, a configuration in which the frame part 4 is fixed to the membrane part 3 using an adhesive or a rivet may be used.

While a case in which the first sensor 5 and the second sensor 6 are provided in the cymbal damping tools 1, 201, and 301 has been described in the above embodiments, the disclosure is not necessarily limited thereto. The first sensor 5 and the second sensor 6 of the cymbal damping tools 1, 201, and 301 may be omitted. In this case, the cymbal 20 and the hi-hat cymbal 30 can be used as a cymbal for practice.

While a case in which the sensor 5*b* of the first sensor 5 is a piezoelectric sensor and the second sensor 6 is a sheet-shaped membrane switch has been described in the above embodiments, the disclosure is not necessarily limited thereto. Of course, other sensors that can detect vibration and other sensors that can detect contact can be used. Examples of the sensor that can detect vibration include a piezoelectric sensor, an electrodynamic sensor, and an electrostatic capacitive sensor. In addition, examples of the sensor that can detect contact include a conductive rubber sensor, a cable sensor, a vibration sensor, and an electrostatic capacitance type touch sensor.

While a case in which vibration of the cymbal 20 and the top hi-hat 40 is detected by the sensor 5*b* using a piezoelectric sensor has been described in the above embodiments, the disclosure is not necessarily limited thereto. For example, the first sensor 5 may be configured using a microphone. That is, since the cymbal damping tools 1, 201, and 301 can prevent the original sound quality of the cymbal 20 and the top hi-hat 40 from deteriorating, preferably, a microphone picks up and outputs a raw sound rather than converting the raw sound into an electronic sound based on an output of a piezoelectric element. Thereby, the cymbal 20 and the top hi-hat 40 can be used as an electric cymbal.

While a case in which the spacer 8 is made of felt has been described in the above embodiments, the disclosure is not necessarily limited thereto. The material of the spacer 8 can be appropriately changed to a material having predetermined elasticity. For example, rubber, a thermoplastic elastomer, and a foamed synthetic resin such as a polyurethane foam may be exemplified.

While a case in which the recessed part 2*a* and the projection 7*b* are formed as irregularities that extend in a V-shaped cross section, and the cylindrical part 2 can swing with respect to the limiting member 7 has been described in the first and second embodiments, the disclosure is not necessarily limited thereto. For example, a configuration in which the cylindrical part 2 and the limiting member 7 are engaged with each other as columnar irregularities, and the cylindrical part 2 is fixed to the limiting member 7 in a non-swingable manner, and thus rotation of the membrane part 3 is limited may be used. Even if the cylindrical part 2 is fixed to the limiting member 7 in a non-swingable manner, since the membrane part 3 has predetermined flexibility, the membrane part 3 can be swung with respect to the cylindrical part 2.

While a case in which the covering member 209 is made of a reticulated material using a resin material has been described in the second embodiment, the disclosure is not necessarily limited thereto. For example, the covering member may be formed into a reticulated form using a natural fiber or a chemical fiber or may be made of a reticulated material having elasticity. That is, when a material and a thread diameter (aperture ratio) of the covering member are appropriately changed, a degree of damping may be regulated to a desired level.

While a case in which the covering member 209 is formed of a polyester mesh having a thread diameter of 1 mm and a number of meshes (a number of threads per inch) set to 8 has been described in the second embodiment, the disclosure is not necessarily limited thereto. For example, preferably, a covering member is formed of a polyester mesh having a thread diameter of 0.8 mm to 1.2 mm and a number of meshes set to 5 to 10. Thereby, it is possible to impart a rigidity higher than that of the membrane part 3 (a rigidity lower than that of the cymbal 20) which is a self-sustaining degree of rigidity to the covering member.

While a case in which the first covering part 209*a* that is positioned outward in the radial direction from the cymbal washer 12 is not in contact with the upper surface of the bell part 21, and a part at which the first covering part 209*a* and the second covering part 209*b* are connected is brought into contact with the bow part 22, and the second covering part 209*b* that is positioned outward in the radial direction from the contact part is not in contact with the bow part 22 has been described in the second embodiment, the disclosure is not necessarily limited thereto.

For example, a configuration in which the entire first covering part 209*a* and second covering part 209*b* that are positioned outward in the radial direction from the cymbal washer 12 are not in contact with the upper surface of the cymbal 20 may be used, or a configuration in which only the outer edge of the second covering part 209*b* outward in the radial direction from the cymbal washer 12 is brought into contact with the upper surface of the cymbal 20 may be used. In addition, a configuration in which a spacer is provided between the covering member 209 and the cymbal 20 and the entire covering member 209 is not in contact with the upper surface of the cymbal 20 during non-striking may be used.

In this manner, when an area of the covering member 209 in contact with the cymbal 20 during non-striking is appropriately set, it is possible to regulate a degree of damping by the covering member 209. In addition, a configuration in which, in order to regulate an area of the covering member 209 in contact with the cymbal 20, a shape and a size of the covering member 209 are appropriately changed, and a part of the upper surface of the cymbal 20 is not covered with the covering member 209 but it is exposed may be used.

What is claimed is:

1. A cymbal damping tool that is attached to a cymbal, comprising:

a cylindrical part;

a membrane part configured to be a film shape or reticulated and having an inner edge connected to the cylindrical part and disposed on a lower surface side of the cymbal;

a frame part connected to an outer edge of the membrane part; and a first sensor attached to an upper surface of the membrane part.

2. The cymbal damping tool according to claim 1, wherein the frame part is made of a material having higher rigidity than the membrane part.

3. The cymbal damping tool according to claim 1, wherein the outer edge of the membrane part is positioned on an outer peripheral side relative to an outer edge of the cymbal.

4. The cymbal damping tool according to claim 1, wherein the frame part comprises a protrusion that protrudes to at least one side of the membrane part in an axial direction with respect to the outer edge of the membrane part.

5. The cymbal damping tool according to claim 1, wherein the membrane part is made of a reticulated material.

6. The cymbal damping tool according to claim 1, wherein the membrane part is fixed to the frame while having slackness.

7. The cymbal damping tool according to claim 1, wherein a cushion is disposed between the first sensor and the cymbal.

8. The cymbal damping tool according to claim 1, wherein the cymbal is supported by a bar-shaped rod and the rod is inserted into the cylindrical part, wherein the cymbal damping tool comprises a limiting member that limits rotation of the membrane part with respect to the rod, and wherein the cylindrical part and the limiting member are engaged with each other by recessed and projection structures therebetween to limit rotation of the membrane part with respect to the rod.

9. A cymbal damping tool comprising:

a membrane part that is formed in a disc shape having a through-hole at center of the membrane part and formed into a film shape or a reticulated using a material having predetermined flexibility; and a frame part that is made of a material having higher rigidity than the membrane part and is connected to an outer edge of the membrane part.

10. The cymbal damping tool according to claim 9, wherein the frame part comprises a protrusion that protrudes to at least one side of the membrane part in an axial direction with respect to the outer edge of the membrane part.

11. The cymbal damping tool according to claim 9, wherein the membrane part is made of a reticulated material.

12. The cymbal damping tool according to claim 9, wherein the membrane part is fixed to the frame while having slackness.

13. The cymbal damping tool according to claim 9, wherein the membrane part is disposed on a lower surface side of a cymbal, and wherein the outer edge of the membrane part is positioned on an outer peripheral side relative to an outer edge of the cymbal.

14. The cymbal damping tool according to claim 13, wherein the frame part comprises a protrusion that protrudes upward with respect to the outer edge of the cymbal during non-striking.

15. The cymbal damping tool according to claim 13, comprising a covering member that is formed in a disc shape having a through-hole into which the rod is inserted at center of the covering member and covers an upper surface of the cymbal, wherein the covering member is made of a material having higher rigidity than the membrane part and has a self-sustaining degree of rigidity, and wherein at least a part of the covering member is not in contact with the cymbal during non-striking.

16. The cymbal damping tool according to claim 15, wherein the covering member is made of a reticulated material.

17. A method of producing a cymbal damping tool, comprising:

forming a film-shaped membrane part in a disc shape having a through-hole at center of the membrane part using a material having predetermined flexibility; and die molding a frame part to an outer edge of the membrane part using a material having higher rigidity than the membrane part, and integrally forming the frame part with the membrane part.

18. The method of producing a cymbal damping tool according to claim 17, wherein the frame part comprises a protrusion that protrudes to at least one side of the membrane part in an axial direction with respect to the outer edge of the membrane part.

19. The method of producing a cymbal damping tool according to claim 17, wherein the membrane part is made of a reticulated material.

20. The method of producing a cymbal damping tool according to claim 17, wherein the membrane part is fixed to the frame while having slackness.

* * * * *